United States Patent [19]

Stempfle et al.

[11] 4,007,365

[45] Feb. 8, 1977

[54] LIGHTING FIXTURE WITH TILTABLE REFLECTOR ELEMENTS

[75] Inventors: Hans Stempfle; Werner Rothe, both of Traunreut, Germany

[73] Assignee: Siemens Aktiengesellschaft, Munich, Germany

[22] Filed: Apr. 9, 1975

[21] Appl. No.: 566,316

[30] Foreign Application Priority Data

Apr. 10, 1974 Germany ..... 2417605

[52] U.S. Cl. ..... 240/41.35 F; 240/44.1

[51] Int. Cl.[2] ..... F21V 7/00

[58] Field of Search ..... 240/41.35 F, 44.1

[56] References Cited

UNITED STATES PATENTS

| | | | |
|---|---|---|---|
| 707,982 | 8/1902 | Taylor | 240/44.1 X |
| 2,727,980 | 12/1955 | Farber et al. | 240/44.1 UX |

FOREIGN PATENTS OR APPLICATIONS

| | | | |
|---|---|---|---|
| 400,680 | 11/1933 | United Kingdom | 240/41.35 F |

*Primary Examiner*—George H. Miller, Jr.
*Attorney, Agent, or Firm*—Kenyon & Kenyon Reilly Carr & Chapin

[57] ABSTRACT

In a lighting fixture having a reflector arrangement with at least two opposed lateral reflectors bounding the light egress opening between which a lamp is supported, the lateral reflectors mounted at an angle of inclination which can not be changed relative to the plane of the light egress opening, an additional reflector element is adjustably arranged above each lateral reflector such that it can be tilted toward the lamp making possible a change of the light distribution curve.

10 Claims, 16 Drawing Figures

LIGHTING FIXTURE WITH TILTABLE REFLECTOR ELEMENTS

BACKGROUND OF THE INVENTION

This invention relates to lighting fixtures in general and more particularly to an improved lighting fixture in which the light distribution curve can be simply and effectively changed.

Lighting fixtures are known in which opposed lateral reflectors bounding the light egress opening and enclosing the lamp between them are mounted on support means at an angle of inclination which can not be changed relative to the plane of the light egress opening. In one known fixture the lateral reflectors are arranged such that they can be horizontally adjusted. However, the angle of inclination of the lateral reflectors with respect to the plane of the light egress opening remains unchanged. In another known type of lighting fixture only the angle of inclination is changeable with the lateral reflectors as a whole arranged tiltable about an axis parallel to the longitudinal axis of the lamp. These lighting fixtures are of types designed in particular for street lighting and quite often will be used in conjunction with mercury vapor lamps or the like.

In these known lighting fixtures, however, a change of the basic shape of the light distribution curve, hereinafter the LDC, is not possible. Instead, only the location of the two radiation maxima in the vertical and/or horizontal plane can be changed. It is not possible to increase the light intensity in the region of the minimum between the two radiation maxima.

As a result lighting fixtures of this nature do not allow a lighting installation, such as street lighting installation, to be optimally adjusted to the surface of the street pavement in all cases. The surface structure of the street pavement can vary from a dull surface to a very smooth surface and can contain greatly differing color components. These factors determine the reflecting properties of the pavement which must be matched to the light distribution of a lighting fixture if the most uniformly possible light density distribution is to be achieved. Furthermore, since the reflecting properties of a pavement change with time, corresponding adaptations of the LDC of the light fixture is also desireable. Starting with these considerations in mind, the present invention is based on the fact that for optimum adaptation of the lighting fixture to the pavement conditions in each case, the characteristics of the LDC of the lighting fixture must also be variable between an extremely wide radiation pattern and a nearly circular pattern.

It is known that the two lateral mirrors of a trough-like reflector of three plane elements linked to each other can be constructed. However, a large number of possible adjustments makes it a practical impossibility to utilize such structures for adapting the light distribution curve to the nature of the street surface in each given case since it would require tests and measurement taking a number of days to perform and would still not lead to an optimal result which could be transferred to other light fixtures of the same type. This is particularly true since in this known type of device no interrelationship of any kind between the reflecting properties of the street surface the light distribution curve optimally adapted to such street surface and the adjustment of the reflector elements therefor are known. Furthermore, in this known type of device, as the mirrors are moved, the glare conditions also change.

In view of these problems with prior art apparatus, the need for an improved lighting fixture of the general type described above in which the light distribution curve can be adapted to the different reflecting properties of the street pavement through a simple adjustment in an optimal and reproducible manner becomes evident.

SUMMARY OF THE INVENTION

The present invention is based on the discovery that it is possible through adjustment of a single reflector element on each side of the lamp between two limiting positions to obtain adjustment of the light distribution curve without changing the glare conditions. In accordance with the present invention this is accomplished by providing in a light fixture having two fixed lateral reflectors, additional reflector elements arranged adjustably thereabove which can be tilted toward the lamp. Through this arrangement the light distribution curve can be changed and furthermore can be changed in a simple manner in that a gradual change is possible when the reflector elements are gradually moved from one limiting position to the other. It thus becomes possible to obtain continuous variation from an extremely wide radiation pattern to a nearly circular pattern. Various embodiments of the present invention are disclosed. In some, adjustable reflector elements are linked to the lateral reflectors. In one case they are linked within a cutout opened toward the top of the fixed lateral reflectors. The lateral reflectors are shown designed in a well known manner in the form of shells with continuous curvature as being composed of individual plane reflectors elements.

In accordance with the present invention it is additionally advantageous if the support of the lamp and the reflector arrangement is arranged in a well known manner rotatable about a horizontal and a vertical axis, so that the maxima of the light distribution curve can be rotated in the horizontal plane and can also be tilted with respect to the vertical. In addition, it is within the scope of the present invention to move the adjustable reflector elements during changing of weather conditions, such as wet pavement conditions, automatically so that a less widely radiating and more deeply radiating LDC is obtained during these conditions. Such is desireable for optimum illumination if the roadway is wet.

DETAILED DESCRIPTION OF THE PREFERRED EMBODIMENT

Figure 1:
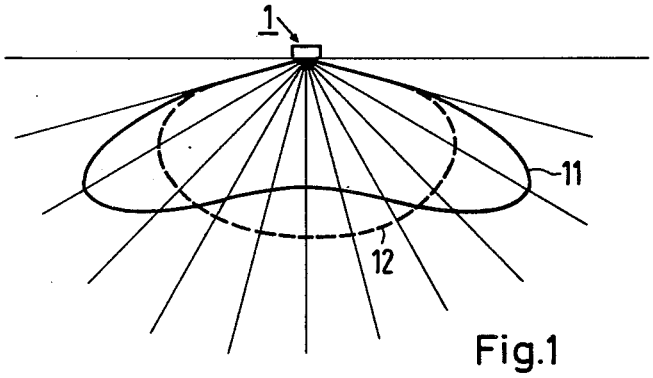
FIG. 1 illustrates light distribution curves which can be obtained with the arrangement of the present invention.

FIG. 1 illustrates two light distribution curves for a lighting fixture 1 made in accordance with the present invention. The curve 11 shown in solid lines is the type of curve particularly suited for a dull street pavement. The curve 12 shown in dotted lines is more suited to a smooth street surface.

Figure 2:
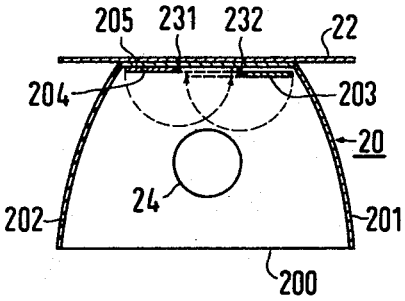
FIG. 2 is a cross section through a first embodiment of a lighting fixture according to the present invention in which tiltable reflector elements are linked to the support for the fixture.

FIG. 2 illustrates a first embodiment of the present invention. In the arrangement shown thereon, a support means 22 is provided supporting a bulb-shaped lamp 24 and on both sides thereof stationary lateral reflectors 201 and 202 with essentially parabolic curvature in two mutually perpendicular cross section planes. The overall reflector 20 includes these reflectors 201 and 202 along with a diffuse reflecting bottom portion 205 and two adjustable reflector elements 203 and 204 linked to the bottom 205 by means of hinges 231 and 232. In the position shown, the surface of these elements 203 and 204 facing the light egress opening 200 are reflecting mirror surfaces. The other surface is a diffuse reflector. In the position shown by solid lines in FIG. 1 a curve such as the curve 12 of FIG. 1 will be obtained. With the elements 203 and 204 rotated to the position shown in dotted lines, LDC 11 of FIG. 1 will be obtained. Through intermediate positioning of the reflector elements 203 and 204 intermediate shapes of the LDC can be obtained. These intermediate positions as can be obtained through the use of conventional detent means.

Figure 3A:
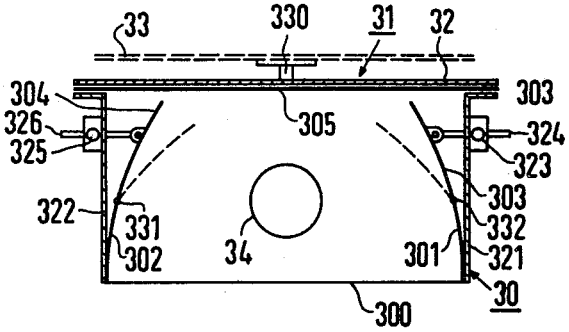
FIG. 3*a* is a cross section through an optical system according to the present invention in which tiltable reflector elements are linked to lateral reflectors.
Figure 3B:
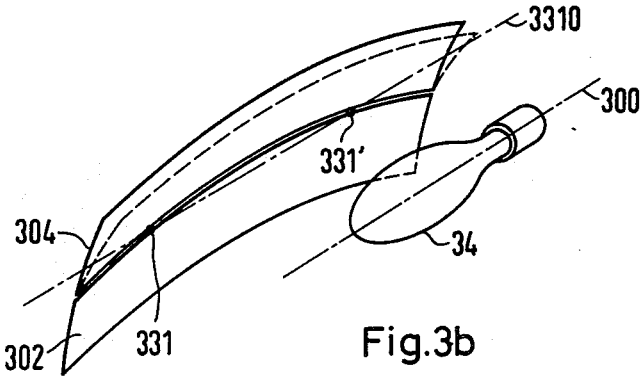
FIG. 3*b* is perspective view illustrating the use of the arrangement of FIG. 3*a*.

FIGS. 3*a* and 3*b* illustrate a further embodiment of the present invention. This embodiment includes an overall optical arrangement designated as 31 surrounding a lamp 34 such as a mercury vapor lamp arranged along an axis 300. The optical elements are attached to a support means 32 which is mounted for rotation about a horizontal axis 33 which is in turn supported in conventional fashion so that it can be tilted about a vertical axis in the housing of the lighting fixture, not shown in detail herein. The support 32 is arranged to support the lamp 34 and sidewalls 321 and 322. Mounted to the sidewalls 321 and 322 are portions of the reflector arrangement designated generally as 30 comprising the disc shaped lateral reflectors 301 and 302. The overall reflector arrangement also includes the reflector elements 303 and 304 which are hinged to the lateral reflectors 301 and 302 and a top surface 305, which unlike the other mirror-like surfaces, is a diffuse surface. The reflectors 301 and 302 are rigidly attached to the respective sidewalls 321 and 322. The reflector elements 303 and 304, are hinged about axis 3310 shown in more detail on FIG. 3*d*. These are adjustable between the position shown in solid and dotted lines by means of arms 324 and 326 which when properly positioned are retained in place set screws 323 and 325. Preferably the horizontal plane passing through the axis of rotation 3310 is above the lamp axis 300.

Figure 4:
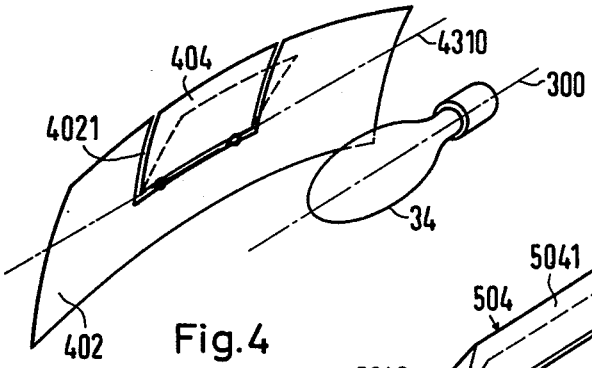
FIGS. 4–7 illustrate different alternate embodiments of lateral reflectors than can be used in optical system according to FIG. 3*a*.

FIGS. 4–7 illustrate alternates of the embodiment of FIG. 3*a*. In FIG. 4, the lateral reflector 402 which is equivalent to the reflector 302 of FIG. 3*a* contains a cutout 4021 in its center section in which cutout is hinged a reflector element 404 adjustable about the axis 4301.

Figure 5:
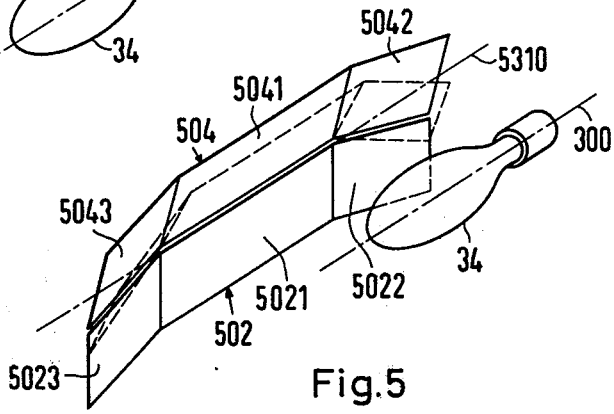

The embodiment of FIG. 5 uses only plane mirrors. The lateral reflector 502 replacing the reflector 302 of FIG. 3*a* is made up of the portions 5021, 5022 and 5033. The middle portion 5021 is essentially parallel to the lamp axis 300 with the lateral pieces 5022 and 5023 bent toward the lamp 34. The adjustable reflector element 504 also comprises three parts, a center part 5041, hinged at the central piece 5021 to be rotatable about an axis 5310, and lateral pieces 5042 and 5043 bent toward the lamp.

Figure 6:
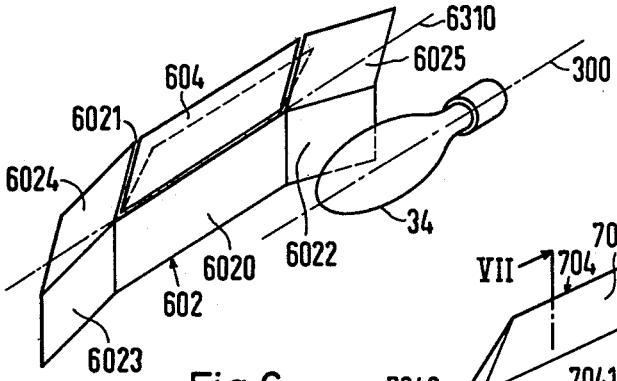
Figure 7:
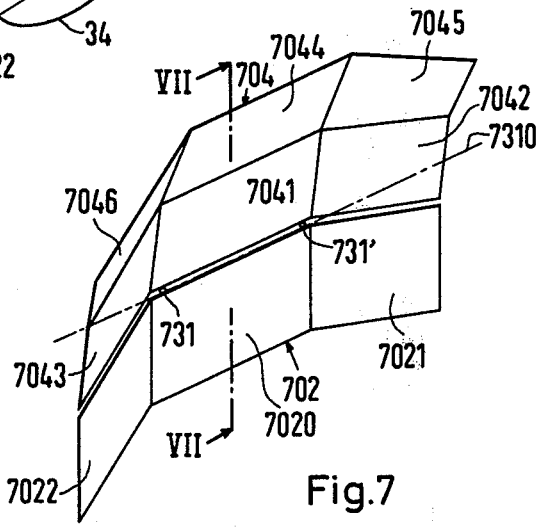
Figure 7A:
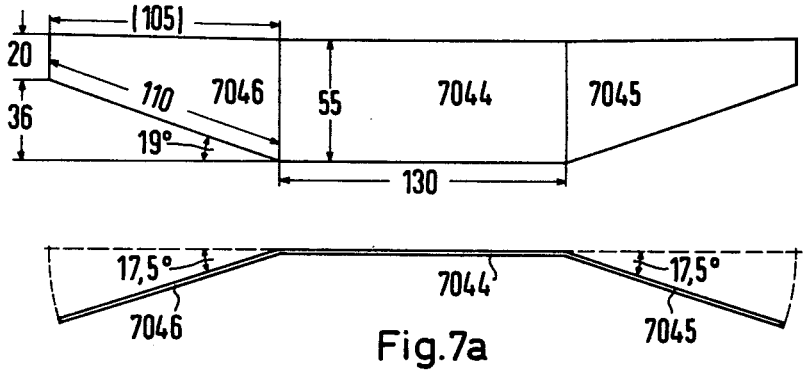
FIGS. 7*a–c* are developments in cross sections of individual parts of the reflector of FIG. 7.
Figure 7B:
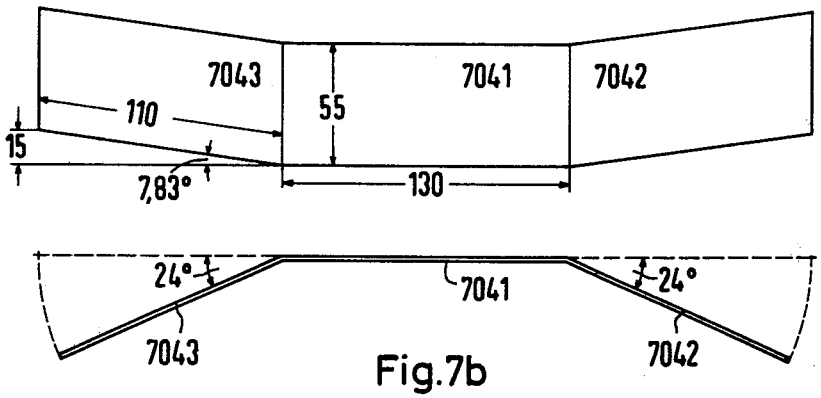
Figure 7C:
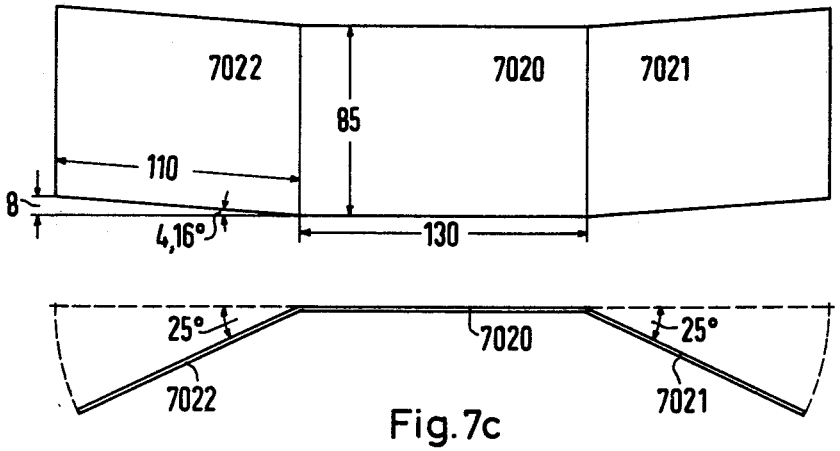

The embodiment of FIG. 6 is similar to that of FIG. 5 with the lateral reflector 602 made up of the sections 6020, 6022 and 6023. However, in this embodiment the upper portions 6024 and 6025 are rigidly attached to the corresponding lower portions 6023 and 6022 and only top reflector 604 is rotatable about the axis 6310. In other words, this embodiment is essentially equivalent to that of FIG. 4 in that it comprises a lateral reflector 602 having a cutout 6021 in which a reflector element 604 is rotatable. FIG. 7 also illustrates another embodiment of the invention in which all reflector elements are also plane mirrors. In the illustrated arrangement, the lateral reflector 702 is made up of the portions 7020, 7021 and 7022. As in the embodiment described above, the portion 7020 will be essentially parallel to the axis of the lamp with the sections 7021 and 7022 bent inward. Linked to the center portion 7020 by suitable hinges is an adjustable reflector portion 704 also made up of plane mirror surfaces. Included are a first layer of mirror surfaces including a central section 7041 and two angled side portions 7042 and 7043 along with an additional layer having a central portion 7044 and angled side portions 7045 and 7046. Each of the portions is inclined with respect to the other in the manner more fully shown on FIGS. 7*a*–7*c*. Each of the figures 7*a*–7*c* shows in the upper portion, a plan view of a single piece of sheet material out of which the respective sections can be bent. A lower portion of each figure illustrates the bending of the side pieces. The particular angles shown on the figure have been found to be advantageous in the fixture of the present invention.

Figure 7D:
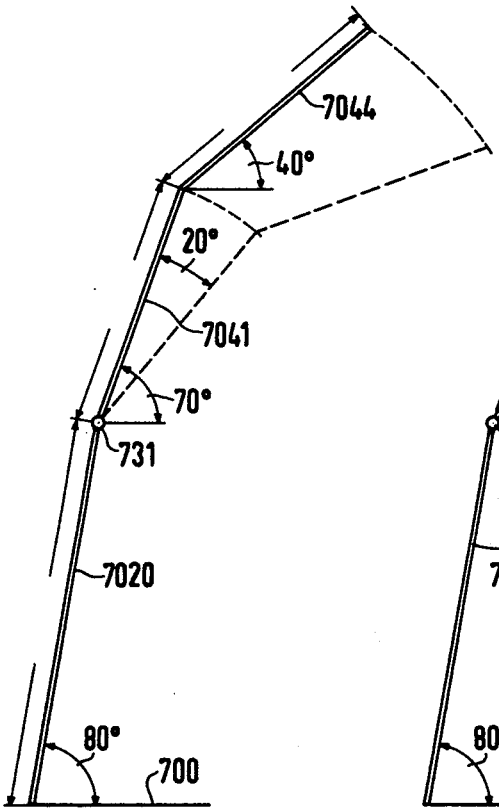
FIG. 7*d* and 7*e* are cross sections of the mirrors of FIG. 8 along the line VII—VII showing the two extreme positions.
Figure 7E:
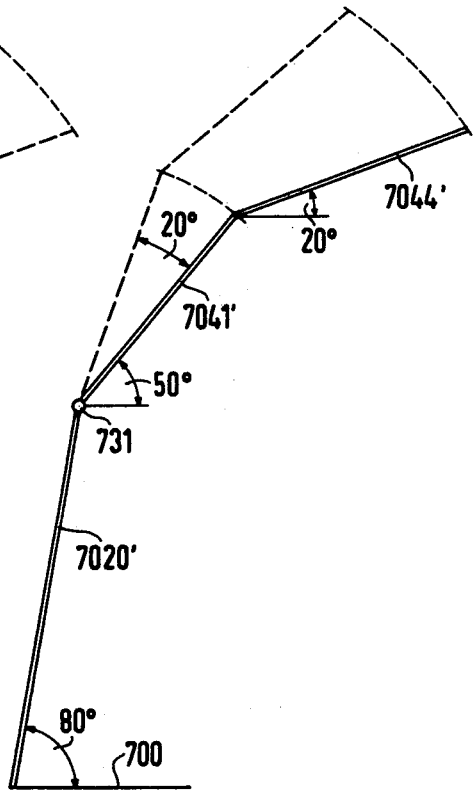

FIGS. 7*d* and 7*e* illustrate two extreme positions for the arrangement of FIG. 7 along with giving representative dimensions of the various sections. These cross sectional views are taken along the line VII—VII of FIG. 7. The inclination of the lateral reflector 7020, i.e. 80° is given with respect to the plane of the light egress opening 760. The cross-section is obtained by a plane perpendicular to the lamp axis and to the egress opening 700. FIG. 7*d* represents one limiting position for producing LDC 11 of FIG. 1 whereas FIG. 7*e* illustrates the other limiting position for producing the LDC 12 of FIG. 1.

The embodiment with the dimensions of FIGS. 7–7*e* provides excellent results where the length of the light egress opening is 280 mm and a high pressure discharge lamp with a phosphor coated bulb, 250 W is arranged in the middle between two lateral reflectors at a height 82 mm above the light egress opening 700. If the reflector is adapted to a different lamp power rating, the angles given remain unchanged although the other dimensions can be adjusted accordingly.

The width of the adjustable reflector element in the embodiment of FIGS. 4 and 6 as well as the width of the central reflector segment in the embodiment of FIGS. 5 and 7 is preferably equal to or larger than the length of the luminous portion of the lamp used in each case.

Figure 8A:
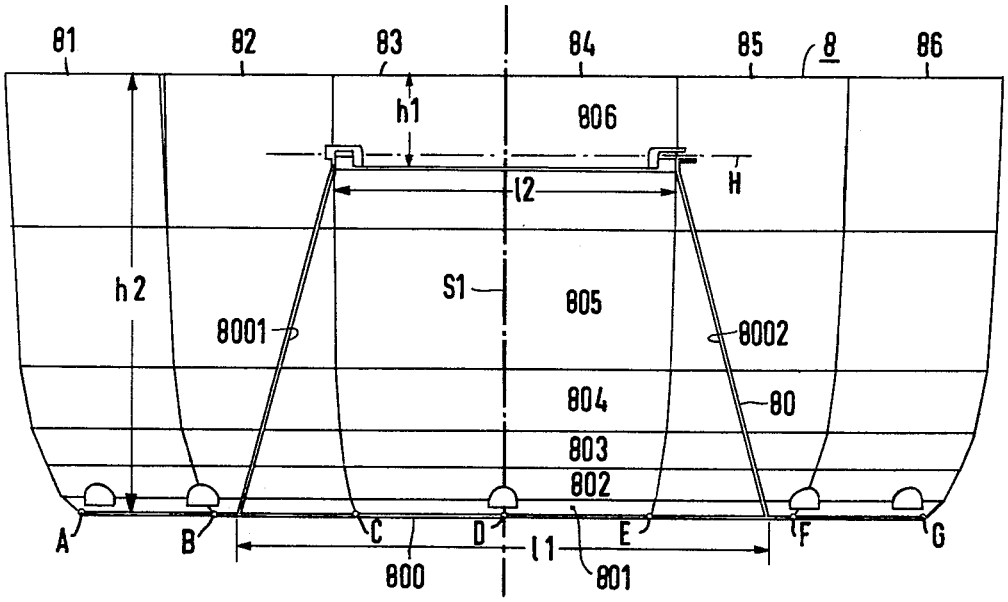
FIG. 8*a* is a side projection of a lateral reflector according to a further embodiment of the present invention looking along the arrow VIIIa of FIG. 8.

FIGS. 8*a*, *b* and *c* illustrate a further embodiment of the present invention in which lateral reflectors 8 are installed on both sides of a vertical plane Z passing through middle of the lamp 34 and the lamp axis 300. Each of the lateral reflectors 8 has a mirror surface and is essentially parabolic and is symmetric about a cross-section vertical plane S1 through the middle of each lateral reflector. The lateral reflectors are arranged so that their base points A, B, C, D, E, F and G which contact with the bottom reflector 807 lie on a parabola having a focal length 14 of between 1.5 and 1.9 in particular 1.8 times the diameter *d* of the lamp. Each reflector 8 is mounted in the lamp housing so that it can be rotated about a point L which lies in the plane S1 bisecting the lateral reflector. The middle M of the lamp 34 is defined by the intersection of the lamp axis 300, and a transverse vertical plane S2 passing through the lamp. Point L is located so that the plane S2 passes therethrough. The lateral reflectors 8 are tilted such that the plane S1 makes an angle of approximately 3° with the plane S2 passing through the middle of the lamp 34. The distance 14 between the points L and P, the focal point of the parabolic reflector, is selected so that the point P lies in the Z plane. The length $l_5$ between the lamp axis 300 and the bottom reflector 807 with respect to the diameter *d* of the lamp should be between 0.5 and 0.8, in particular 0.7.

Figure 8C:
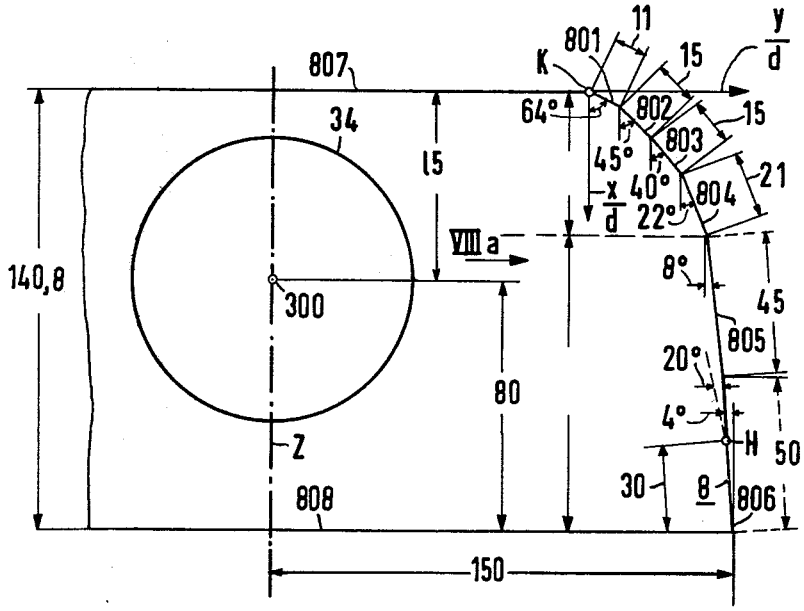
FIG. 8*c* is a cross-section of the same reflector taken along the line VIIIc - VIIIc of FIG. 8*b*.

The shape of the lateral reflectors as shown by the cross-section of FIG. 8*c*, satisfies the following equation:

$$x/d = exp\ [K_1(y/d)^{0.4} - K_2]$$

where *x* is the vertical distance from an origion K, *y* is the lateral distance therefrom and *d* is lamp diameter. In the upper region where the quantity *x/d* is between the limits of 0 and 0.52 the constant $K_1$ is equal to 7.8 and the constant $K_2$ is equal to 6.17. In the lower region where *x/d* is between 0.56 and 1.57, constant $K_1$ is 18.57 and constant $K_2$ 13.95. The end points of the curves in the two regions are connected with each other by a straight line.

As illustrated on the figures, the curve of the above equation is approximated with straight line segments. Each lateral reflector is made up of six identical sections designated 81–86 on FIGS. 8*a* and 8*b*. Each section represents and angle $\beta$ of 10° with each of the sections being symmetrical about a plane such as plane S3.

Each of the six sectors, for example, sector 84, is made up of a plurality of plane reflectors with reflectors 801–804 making up the upper portion of the reflector and 805 and 806 making up the lower portion of the reflector. The height of each of the reflector sections with respect to the diameter of the lamp 34 are as follows starting with top reflector 801: 0.1; 0.11; 0.12; 0.17; 0.23; 0.5 and 0.56. The angles which each of the plane reflector sections make with each other is as illustrated on FIG. 8*c*.

Figure 8B:
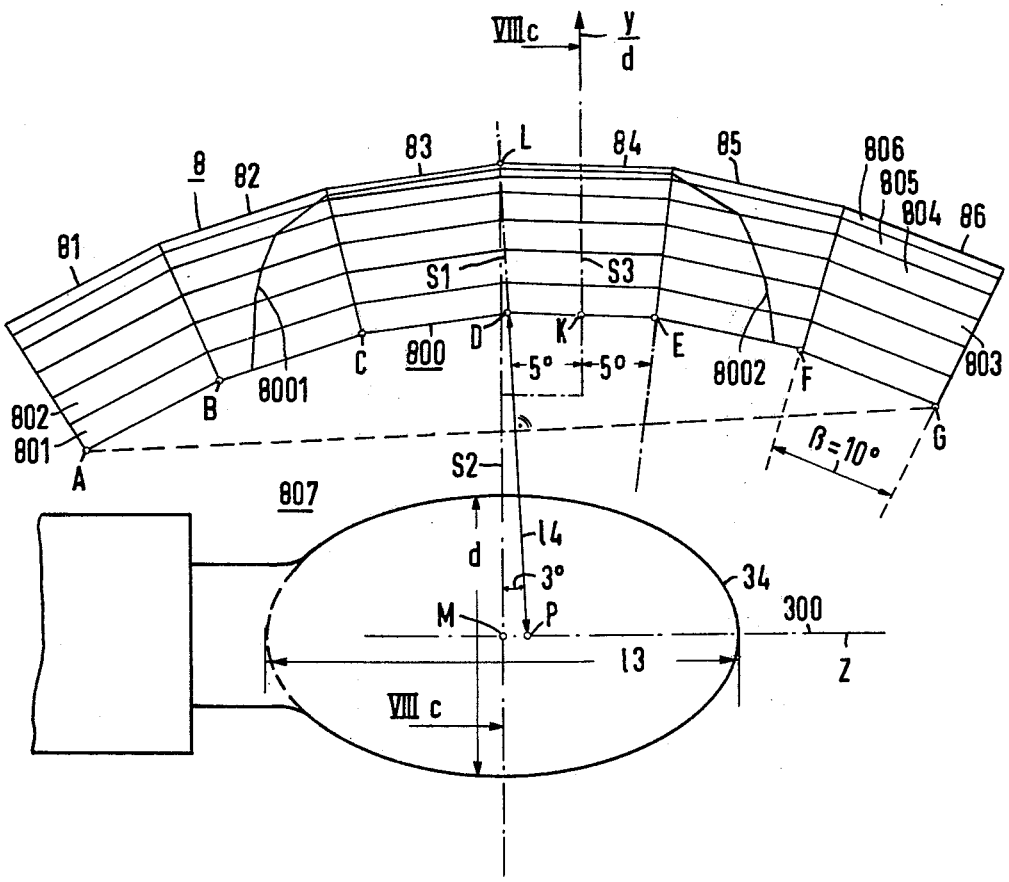
FIG. 8*b* is a horizontal projection of the lateral reflector of FIG. 8*a*, also illustrating the lamp, as seen from below.

FIGS. 8*a* and 8*b* show the manner of forming an adjustable reflector portion 800 which is hinged to each of the lateral reflectors about on axis H. This hinged, movable section may be formed by simply making a cutout 80 in the reflector 8 along the lines 8001 and 8002 of FIGS. 8*a* and 8*b*. As shown on 8*a*, in the vertical projection, these lines comprise straight lines. These lines should be cut so that the ratio of the length $l_1$ across the bottom to the length $l_2$ across the top of the adjustable reflector portion 800 is between 1.3 and 1.7, in particular 1.54, with the length $l_2$ selected so that it is at least 75% of the length of the luminous portion of the lamp. If the lamp is a high pressure discharge lamp 34 with a phosphor coated bulb then the length $l_1$ with respect to the length $l_3$ of the lamp, as measured between the end points of the elipse forming the lamp outline, should be between 1.1 and 1.3 in particular 1.18.

The height hl of the portion of the lateral reflector 8 above the hinged portion 800 should be between 19% and 22%, in particular 21.1% of the total height as viewed in the lateral projection of FIG. 8*a*.

With the embodiments of FIGS. 8*a*–8*c* adjustment of the LDC can be obtained in a particularly effective manner. This is because the beam intensity at a very large angle from the vertical is primarily controlled by the height *hl* and the depth of radiation is primarily controlled by the wider upper region of the adjusted reflector element 800. As positioned on the FIGS. 8*a*–8*c* this embodiment will result in a wide pattern such as that of curve 11 of FIG. 1. To change the lamp for illumination of a street pavement with a particularly smooth surface i.e. to obtain curve 12, it is only necessary to rotate the adjustable reflector element 800 20° about the axis H toward the lamp 34 as shown in FIG. 8*c*.

Thus an improved reflector which permits adjusting the light distribution curve of a lighting fixture, particularly a street lighting fixture, has been shown. Although specific embodiments have been illustrated and described, it will be obvious to those skilled in the art that various modifications may be made without departing from the spirit of the invention which is intended to be limited solely by the appended claims.

We claim:

1. In a wide beam lighting fixture having a reflector arrangement in which two opposed bowl shaped lateral reflectors bounding the dowardly directed light egress opening and enclosing a horizontally arranged lamp between them are fixedly mounted on a support with an angle of inclination which can be changed relative to the plane of light egress opening, the improvement comprising means for permitting adjustment of the light distribution curve including an additional reflector element above each lateral reflector supported so that it can be controllably tilted toward the stationary lamp.

2. Apparatus according to claim 1 wherein the length of each adjustable reflector element is at least equal to the length of the luminous portion of the lamp.

3. Apparatus according to claim 1 wherein said adjustable reflector elements are hinged to said lateral reflectors.

4. Apparatus according to claim 3 wherein each of said lateral reflectors has a dish-like shape and wherein a cutout, opened toward the top is provided in each lateral reflector with said adjustable reflector elements arranged in said cutout.

5. Apparatus according to claim 3 wherein each of said lateral reflectors are made up of a plurality of plane reflectors and where said reflector elements hinged to said lateral reflectors each comprise at least two plane reflectors arranged so as to enclose an obtuse angle.

6. Apparatus according to claim 5 wherein the height of each of said two plane reflectors making up each reflector elements is equal.

7. Apparatus according to claim 6 wherein the heights of each of said plane reflectors is greater than one half the height of said lateral reflector and smaller than the total height of said lateral reflector.

8. A lighting fixture according to claim 5 wherein the angle between said plane reflectors making up said reflector elements is 150°.

9. A lighting fixture according to claim 8 wherein the angle between the plane of the light egress opening and said lateral reflectors is between 70° and 85°.

10. A lighting fixture according to claim 9 wherein said adjustable reflector elements are adjustable between limits corresponding to a first position in which said adjustable reflector elements enclose an obtuse angle with said lateral reflector which is 150° and position a second wherein said angle is 170°.

* * * * *